US005755193A

United States Patent [19]

Mishima

[11] Patent Number: 5,755,193

[45] Date of Patent: May 26, 1998

[54] OUTBOARD MOTOR ENGINE

[75] Inventor: Shuichi Mishima, Iwata, Japan

[73] Assignee: Suzuki Kabushiki Kaisha, Japan

[21] Appl. No.: 711,277

[22] Filed: Sep. 12, 1996

[30] Foreign Application Priority Data

Dec. 27, 1995 [JP] Japan ..... 7-341655

[51] Int. Cl.[6] ..... F02F 7/00

[52] U.S. Cl. ..... 123/195 P; 123/192.2

[58] Field of Search ..... 123/195 P, 192.2

*Primary Examiner*—Noah P. Kamen

*Attorney, Agent, or Firm*—Ronald P. Kananen

[57] ABSTRACT

In an outboard motor, an engine is mounted to an upper portion of an engine holder. A crank shaft is vertically disposed in a crank case of the engine. A plurality of cylinders are arranged in a cylinder block of the engine in parallel with each other in a vertical direction. An oil pan is disposed in the engine holder, and a balancing device is mounted to a bottom surface of the cylinder block facing the oil pan. The cylinder block is disposed between the crank case and a cylinder head. The bottom surface of the cylinder block is recessed. In this recessed portion, a balancing device is disposed.

9 Claims, 2 Drawing Sheets

OUTBOARD MOTOR ENGINE

BACKGROUND OF THE INVENTION

The present invention relates to the engine in an outboard motor. Particularly, the present invention relates to an outboard motor engine having an improved arrangement for a balancing device.

In the engine of an outboard motor, primary vibrations are likely generated due to the reciprocating motion of the piston in a piston-cylinder assembly. In order to eliminate such primary vibrations, some types of engines are provided with balancing devices.

A balancing device is composed such that a balancing weight having a weight substantially equivalent to the total weight of, for example, a piston, a connection rod, etc. is fixed to a balancing shaft. The balancing shaft is operatively connected to a crank shaft which is then rotated. With this arrangement, the primary vibrations are eliminated, particularly when the engine is started.

One example of an engine in an outboard motor provided with such balancing device is disclosed in Japanese Patent Laid-open Publication No. HEI 6-137162 or No. SHO 63-192693. However, the balancing device disclosed in Japanese Patent Laid-open Publication No. HEI 6-137162 is disposed on the front side of the engine. Accordingly, the entire longitudinal length of the engine must be increased, and there is less space in an engine room which is enclosed by an engine casing. The result is a complicated arrangement of air intake tubes or pipes.

On the other hand, the balancing device disclosed in Japanese Patent Laid-open Publication No. SHO 63-192693 has a double-axle structure having two balancing weights. The balancing weights are disposed in the width direction of the engine, so that the width of the engine is unduly increased.

As mentioned above, in both the prior art examples, the outboard motor itself becomes unduly large due to the incorporation of a balancing device. Accordingly, there is a problem in the art providing an engine in a outboard motor which has a compact structure.

SUMMARY OF THE INVENTION

Accordingly, an object of the present invention is to substantially eliminate the defects and drawbacks encountered in the prior art described above and to provide an outboard motor engine having a compact structure even with a balancing device being included.

This and other objects can be achieved according to the present invention by providing an outboard motor in which an engine is mounted to an upper portion of an engine holder. A crank shaft is vertically disposed in a crank case of the engine, a plurality of cylinders are arranged in a cylinder block of the engine in parallel with each other in a vertical direction, and a cylinder head is disposed behind the cylinder block. The outboard motor includes an oil pan disposed in the engine holder and a balancing device is mounted to a bottom surface of the cylinder block facing the oil pan.

Preferably, the cylinder block is disposed between the crank case and the cylinder head, and the bottom surface of the cylinder block is recessed to receive the balancing device. The recessed portion has a bottom surface positioned above in level a bottom surface of the crank case and a bottom surface of the cylinder head.

In the preferred embodiment, the balancing device comprises a master member provided for the bottom surface of the recessed portion so as to project therefrom. A driven balancing gear is mounted to the master member and is made rotatable about a bearing. A balancing weight is provided for the driven balancing gear. A balancing drive gear is mounted to the crank shaft and engaged with the driven balancing gear.

According to the structures as described above, since the balancing device is disposed in a space formed between the cylinder block and the oil pan, the dimensions of the outboard motor in the height direction, the longitudinal direction and the width direction are not increased. Accordingly, the outboard motor itself is not made large and retains a more compact structure.

The space between the cylinder block and the oil pan is a dead space in a conventional arrangement. With the present invention, this formerly dead space is effectively utilized.

The nature and further features of the present invention will be made clear from the following description made with reference to the accompanying drawings.

DETAILED DESCRIPTION OF AN EMBODIMENT OF THE INVENTION

Figure 1:
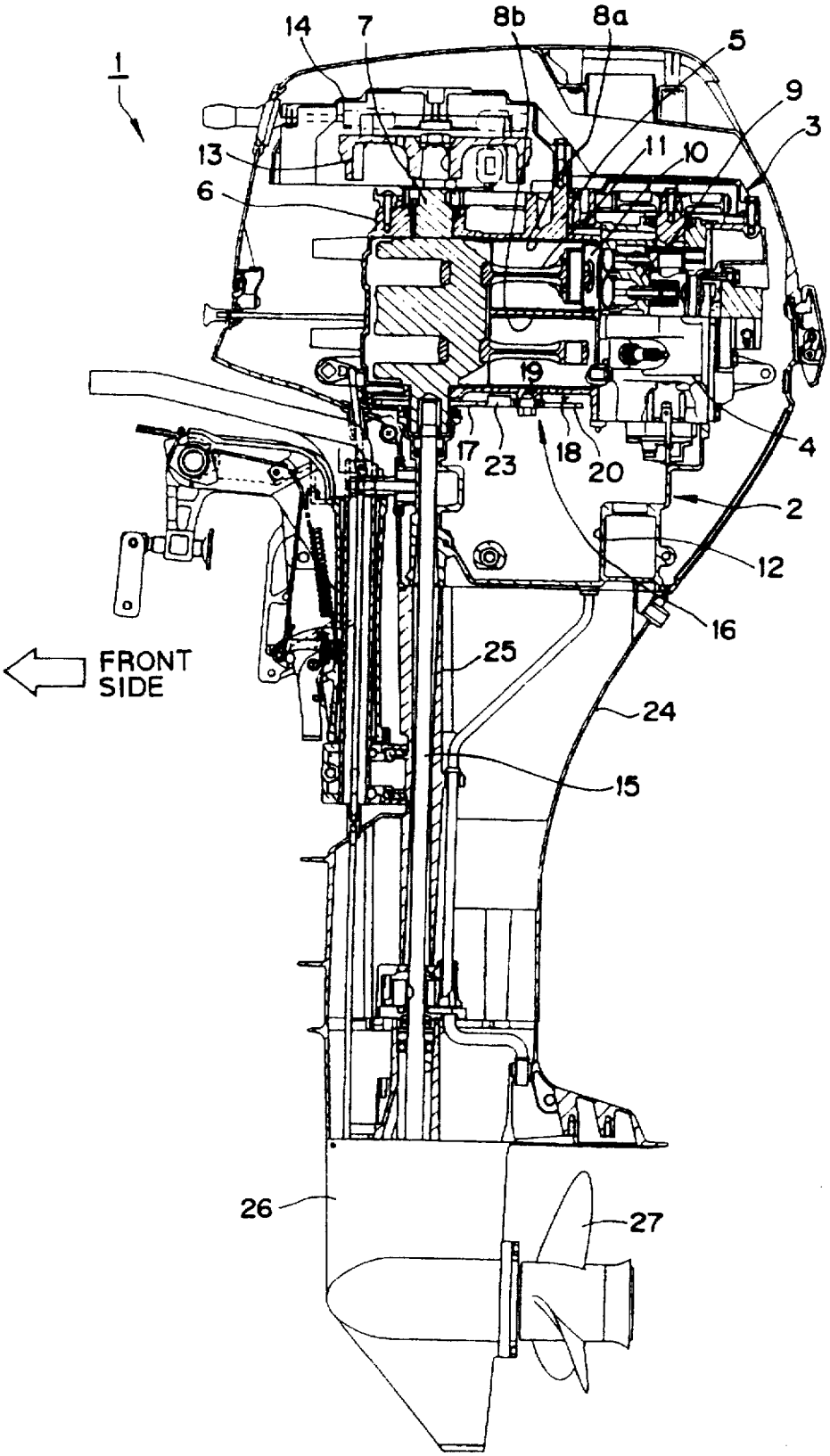
FIG. 1 is an elevational section showing one embodiment of an outboard motor provided with an engine according to the present invention.
Figure 2:
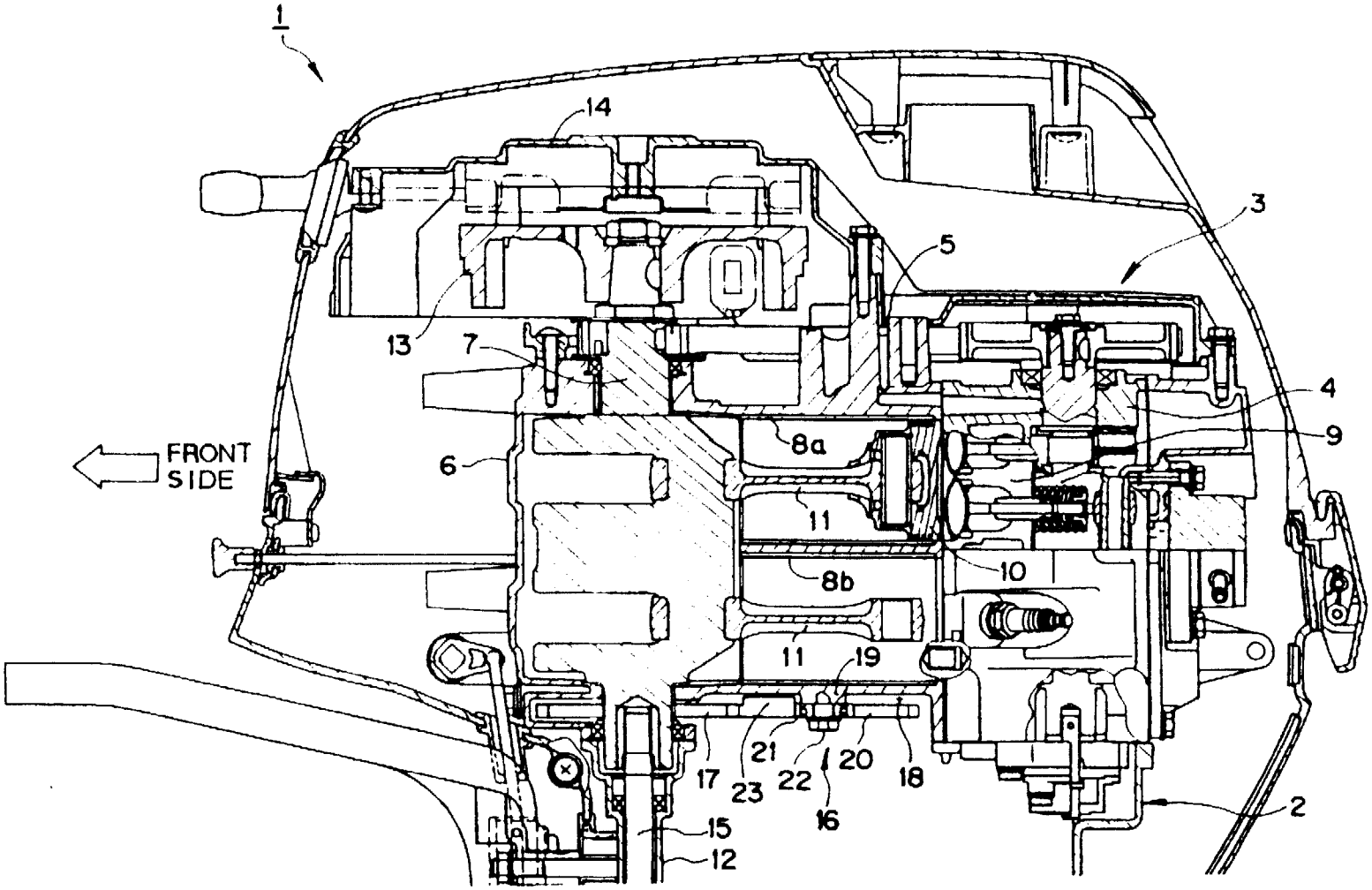
FIG. 2 is also an elevational section of the engine, in an enlarged scale, of the outboard motor of FIG. 1.

Referring to FIG. 1, an outboard motor 1 is provided with an engine holder 2. An engine 3 is disposed on an upper portion of the engine holder 2, as shown. The engine 3 is, for example, a water-cooled, four-stroke-cycle, two-cylinder engine, which is composed of a cylinder head 4, a cylinder block 5, a crank case 6, etc. when in an assembled state. FIG. 2 shows the detailed structure of the engine 3.

With reference to FIGS. 1 and 2, the left side is in the direction of a hull, not shown, to which the outboard motor 1 is mounted. For convenience, the left side of FIGS. 1 and 2 is called the front side of the outboard motor 1 in this disclosure.

As shown in FIG. 2, a crank shaft 7 is arranged substantially in a vertical direction in the crank case 6 of the engine 3. The cylinder block 5 is arranged on a rear side of the crank case 6. A plurality of cylinders, two **8*a* and 8*b* in the illustrated embodiment, are arranged in parallel with each other in the vertical direction. The cylinder head 4, provided with a valve moving mechanism 9, is arranged behind the cylinder block 5**.

Pistons 10 are fitted in the cylinders **8*a* and 8*b* to be slidable in a direction normal to the crank shaft 7. The pistons 10 are operatively coupled to the crank shaft 7 by means of connection rods 11 to convert the reciprocating strokes of the pistons 10 to the rotational motion of the crank shaft 7. An oil pan 12 is formed in the engine holder 2 at a portion of the engine holder 2 below the cylinder head 4, the cylinder block 5 and the crank case 6**.

The upper end portion of the crank shaft 7 extends upward over the crank case 6. A magnet 13 is mounted to the upper end portion of the crank shaft 7. A re-coil starter 14 is also mounted on the upper portion of the magnet 13. A drive shaft 15 extends vertically within the outboard motor structure and has an upper end portion which is fitted, in a spline-fitting manner, into the lower end portion of the crank shaft 7. A balancing drive gear 17 for driving a balancing device 16 is provided to the lower portion of the crank shaft 7.

The portion of the cylinder block 5 disposed below the lower portion of the lower cylinder **8*b* has a bottom surface formed with a recessed portion 18 having a bottom which is positioned above the bottom, i.e. lower, surfaces of the crank case 6 and the cylinder head 4. The recessed portion 18 faces the oil pan 12. The balancing device 16 is disposed in this recessed portion 18**.

A master portion 19 is formed which extends downward to the bottom surface of the cylinder block 5 at which the recessed portion 18 is formed. A driven balancing gear 20 constituting the balancing device 16 is mounted to the master portion 19. The balancing gear 20 is rotatable and is secured by means of bolt 22. The bolt 22 extends through a bearing 21 of the balancing gear 20. A balancing weight 23 having a mass corresponding to the total weight of the pistons 10, the connection rods 11, etc., is provided for the driven balancing gear 20. The driven balancing gear 20 is interlocked with the balancing drive gear 17. The balancing drive gear 17 is connected to the crank shaft 7 and rotates the driven balancing gear 20 in a direction opposite the rotational direction of the crank shaft 7. Alternatively, the balancing drive gear 17 and the driven balancing gear 20 may be operatively connected with a chain or belt.

As shown in FIG. 1, a drive shaft housing 24 is mounted to the lower portion of the engine holder 2. In the drive shaft housing 24, the drive shaft 15 extends into a shaft pipe 25. The drive shaft 15 is adapted to drive a propeller 27 through a bevel gear and a propeller shaft, both not shown, disposed in a gear case 26 formed on the lower portion of the drive shaft housing 24.

The embodiment of the present invention described above attains the following function.

Since the balancing device 16 is disposed in a space formed between the cylinder block 5 and the oil pan 12, the dimensions of the outboard motor in the height direction, the longitudinal direction and the width direction are not increased. Accordingly, the outboard motor 1 itself is not made large, but retains a more compact structure.

The space between the cylinder block 5 and the oil pan 12 is a dead space in a conventional arrangement. However, with the present invention, this dead space is effectively utilized.

Furthermore, since a lubrication oil circulating through the crank shaft 7 and the pistons 10 also lubricates the balancing device 16 when the lubrication oil drops in the oil pan 12, it is not necessary to locate a special lubrication device for the balancing device 16. This further contributes to the compact structure of the outboard motor and reduces the manufacturing cost.

What is claimed is:

1. An outboard motor in which an engine is mounted to an upper portion of an engine holder, a crank shaft is disposed in a crank case of the engine, a plurality of cylinders are arranged in a cylinder block of the engine in parallel with each other, and a cylinder head is disposed adjacent the cylinder block, the improvement comprising:

an oil pan disposed in the engine holder; and a balancing device mounted to a bottom surface of the cylinder block facing the oil pan.

2. An outboard motor according to claim 1, wherein:

said cylinder block is disposed between the crank case and the cylinder head; and said bottom surface of the cylinder block is recessed having a recessed portion in which said balancing device is disposed.

3. An outboard motor according to claim 2, wherein said balancing device comprises:

a master member provided in said recessed portion so as to project therefrom;

a driven balancing gear rotatably mounted to the master member;

a balancing weight provided for the driven balancing gear; and a balancing drive gear mounted to the crank shaft engaging driven balancing gear.

4. An outboard motor according to claim 3, further comprising a bearing for rotatably mounting said driven balancing gear.

5. An outboard motor having an engine mounted to an engine holder, the engine comprising:

a plurality of cylinders are arranged in a cylinder block; and a balancing device mounted to a bottom surface of the cylinder block.

6. An outboard motor according to claim 5, further comprising an oil pan disposed in the engine holder; said balancing device being between said oil pan and said cylinder block.

7. An outboard motor according to claim 5, wherein said balancing device comprises a weighted gear rotatably mounted to said bottom surface of the cylinder block.

8. An outboard motor according to claim 7, further comprising a drive gear which is rotated by a crank shaft of said engine and which drives said weighted gear in a direction opposite a rotational direction of said crank shaft.

9. An outboard motor according to claim 7, wherein said weighted gear is mounted in a recess formed in said bottom surface of said cylinder block.

* * * * *